US005214882A

United States Patent [19]

Rupp

[11] Patent Number: 5,214,882

[45] Date of Patent: Jun. 1, 1993

[54] VACUUM ACTIVATED TOOL FOR THE FABRICATION OF OPTICAL SURFACES

[75] Inventor: Wiktor J. Rupp, Lowell, Mass.

[73] Assignee: Litton Systems, Inc., Lexington, Mass.

[21] Appl. No.: 612,180

[22] Filed: Nov. 13, 1990

[51] Int. Cl.[5] ..... B24B 7/00

[52] U.S. Cl. ..... 51/109 R; 51/362; 51/124 L; 51/273; 51/165.76

[58] Field of Search ..... 51/109 R, 362, 131.5, 51/131.1, 131.3, 131.4, 133, 209 R, 209 DL, 119, 124 L, 129, 273, 165.76, 165.77

[56] References Cited

U.S. PATENT DOCUMENTS 4,627,195 12/1986 Greenleaf ..... 51/109 R 4,860,400 8/1989 Urakami ..... 51/273

*Primary Examiner*—Bruce M. Kisliuk

*Assistant Examiner*—Eileen P. Morgan

*Attorney, Agent, or Firm*—Michael H. Wallach; Robert F. Rotella

[57] ABSTRACT

A tool is disclosed for accurately and rapidly finishing optical surfaces. The tool has a plurality of lapping buttons attached to its face for contacting the optical surface to be finished. The lapping buttons are held to the surface of the workpiece by a suction established between the tool and the workpiece. The suction force existing between the tool and the workpiece is monitored by a controller and may be selectively changed as the tool is moved across the surface of the workpiece during lapping operations. As the tool is moved toward the edge of a workpiece, the vacuum applied to those buttons approaching the edge of the workpiece is increased to achieve desired rate of material removal. The invention permits selective control of the amount of vacuum applied to each lapping button to permit maximum grinding and/or polishing to be achieved. The disclosed tool permits the use of a thinner facesheet in an optical system while permitting a complex surface geometry to be ground into the facesheet.

12 Claims, 3 Drawing Sheets

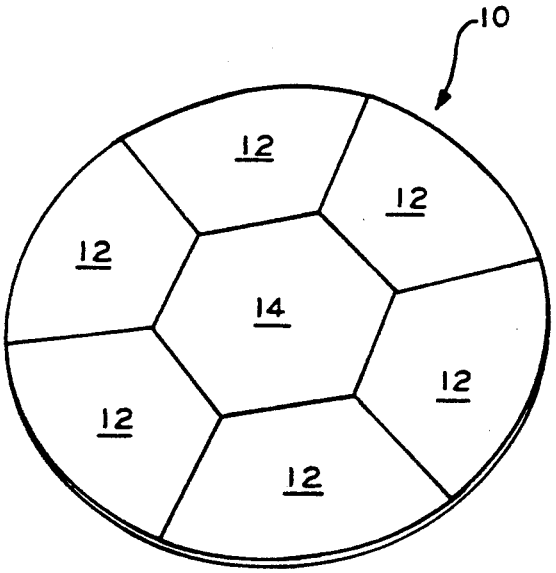
FIG. 1
FIG. 2
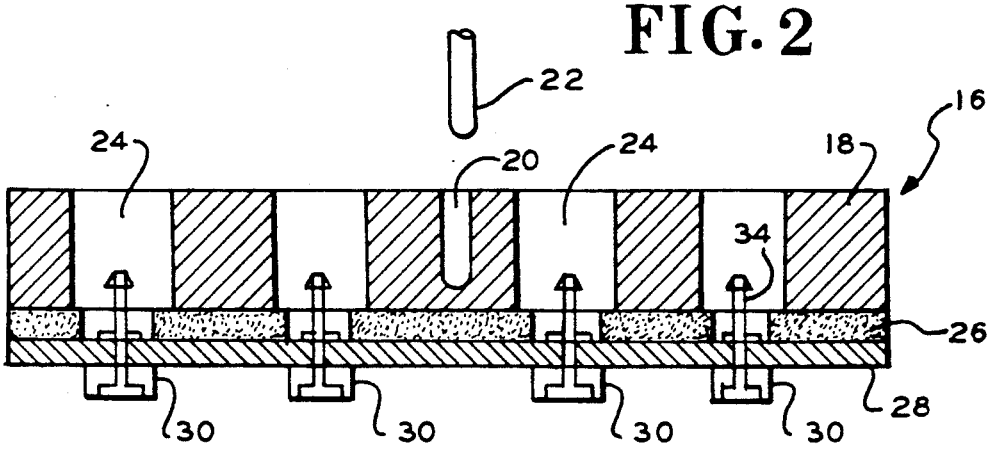
FIG. 3
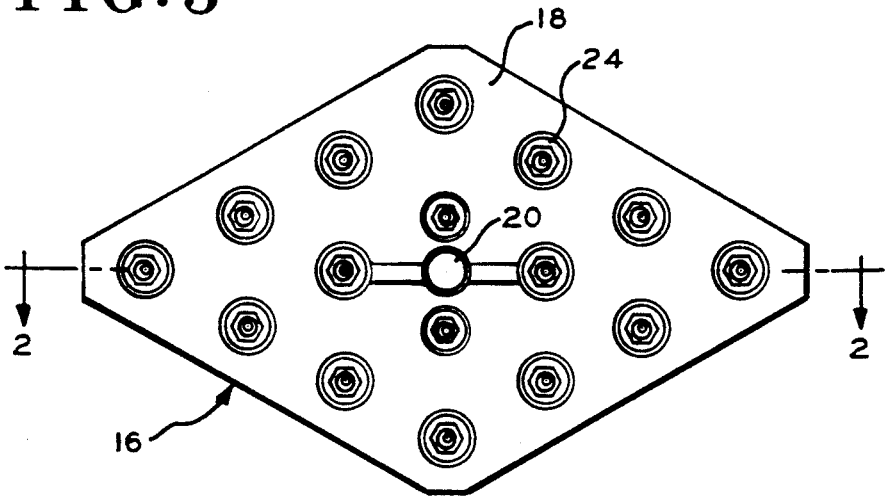

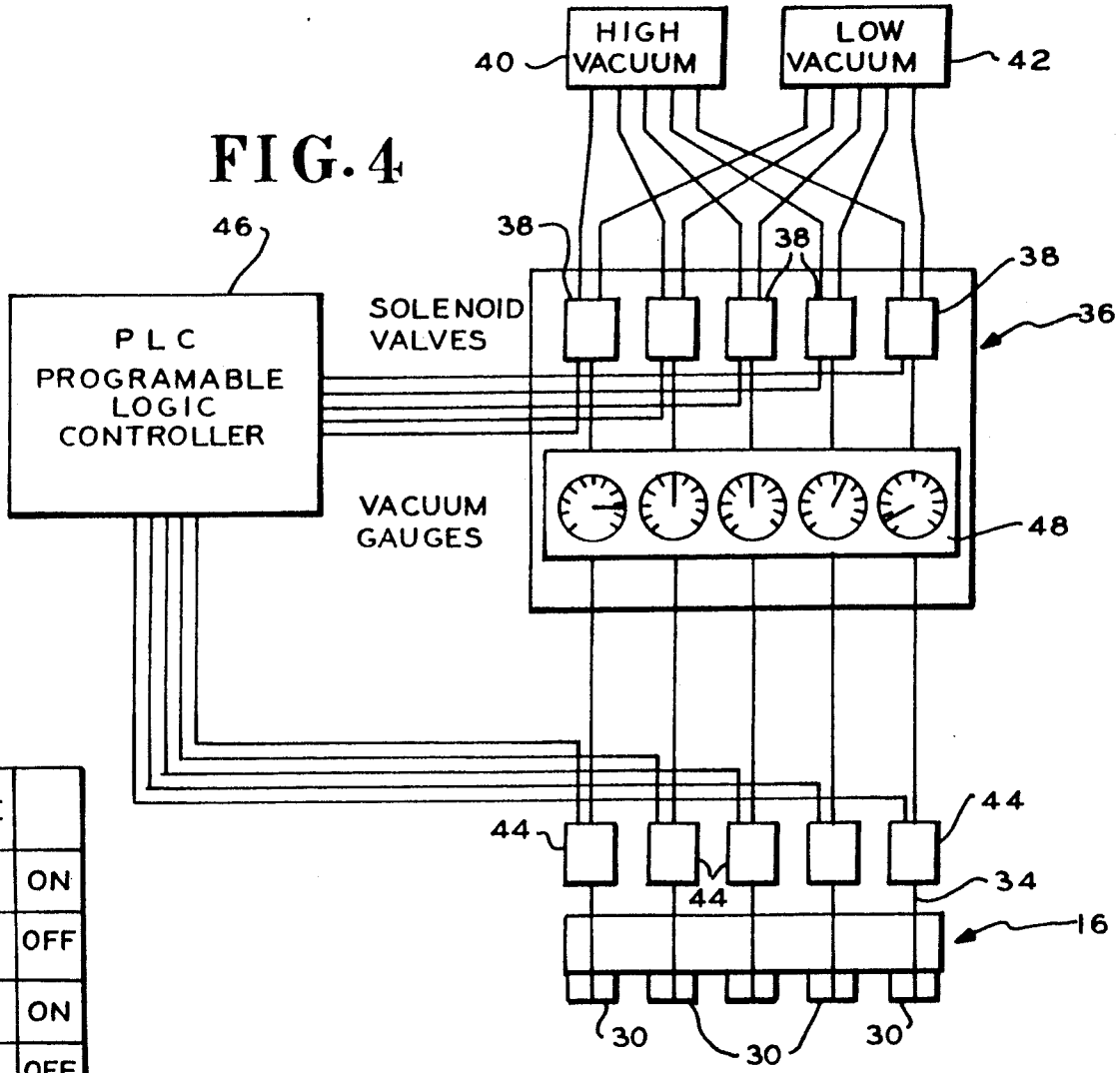
FIG. 4
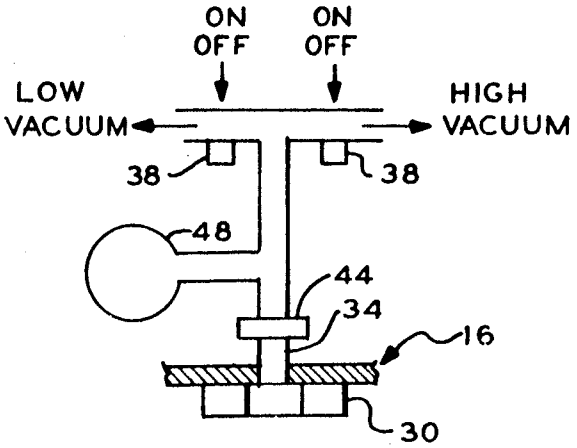
FIG. 5
| | TOOL POSITION | | | |
|---|---|---|---|---|
| | INTERIOR | EDGE | OFF THE BLANK | |
| HIGH VACUUM | | X | | ON |
| | X | | X | OFF |
| LOW VACUUM | X | | | ON |
| | | X | X | OFF |
FIG. 6

VACUUM ACTIVATED TOOL FOR THE FABRICATION OF OPTICAL SURFACES

BACKGROUND OF THE INVENTION

1. Field of the Invention

This invention relates in general to the fabrication of optical surfaces for large mirrors and, in particular, to the fabrication of spherical and aspherical optical surfaces using computer-controlled lapping processes.

2. Description of the Prior Art

The use of large mirrors for astronomical telescopes and for optical systems involved in surveillance systems is well known in the prior art. Historically, large mirrors used for astronomical applications have been manufactured from large blank of glass with the reflecting surface supported by a thick substrate to insure that the shape of the reflecting surface was accurately maintained. As requirements evolved for increasingly larger surface area mirrors, the use of the well known expedient of increasing the thickness of the mirror blank to insure stability of the reflecting surface became less desirable, due to the substantial increase in weight of the mirror structure. Recent advances have resulted in a need for large-diameter mirrors for both astronomical and surveillance applications, with the applications frequently requiring that the mirrors be installed and operated in systems located in earth orbit. The requirement of transporting the mirror from the earth's surface into earth orbit mandates that every effort be made to reduce the weight of the mirror structure, while maintaining the rigidity of the mirror to insure absolute tolerance in the geometry of the mirror's reflecting surface. Due to the difficulty of handling and fabricating large blanks of glass or other material into reflecting surfaces, techniques have been developed for producing lightweight mirror structures which result in relatively rigid reflecting surfaces having high optical tolerances while reducing the overall weight of the mirror. These techniques include the use of machining to reduce the weight of a monolithic blank from which a mirror is fabricated, and the construction of mirrors having large surface areas by utilizing multiple mirror segments, each of which is precisely aligned with adjoining segments to form a large reflecting surface. Mirrors constructed in accordance with the foregoing arrangements utilize mirror components in which the support for the reflecting surface is obtained from a series of support webs which support a relatively thin facesheet which forms the mirror's reflecting surface. Each mirror blank is carefully fabricated so that it may be joined to other blanks to form a reflecting surface whose surface area is substantially larger than that of the individual blanks from which the mirror is fabricated.

In response to the recent development of fabricating large mirrors by assembling mirror segments into a monolithic mirror, attempts have been made to develop techniques for individually lapping the surface of each mirror segment to produce individual mirror sections having reflecting surfaces of a precise geometry across the entire surface which may then be joined together so that the assembled mirror has a reflecting surface with the desired surface geometry. As used herein, the term "lapping" is meant to include the separate processes of "grinding", in which particles of material of a relatively large size are removed and "polishing", in which smaller size particles of material are removed to produce the final optical surface. Such techniques have employed computer controlled machines to grind and to polish the reflecting surface of each segment to achieve the desired surface geometry for the mirror. While this technique is generally useful for producing mirror segments for reflecting surfaces having a large surface area, problems occur when the technique is attempted to be applied to mirror segments in which a high degree of light-weighting is to be achieved (i.e., where more than 80 percent of the weight of a mirror blank is to be removed) and where a web is used to support a very thin facesheet. In particular, attempts at grinding and polishing a thin facesheet with conventional surface grinding tools produces an effect known in the trade as "print-through". In addition, residual surface errors are produced around the edges of the mirror segment because of the difficulty of controlling the grinding and polishing tools near each edge of each mirror segment. Typically, a light weight mirror may have a facesheet for the reflecting surface which is as thin as five to ten millimeters thick which is supported by a rib structure to insure rigidity of the reflecting surface. While operations are being carried out to remove material from the facesheet to produce the desired optical surface geometry, the lapping tool is pressed against the facesheet to control the speed at which material is removed from the facesheet. However, due to the pressure being exerted against the thin facesheet, the facesheet is likely to deflect in places in which it is not directly supported by the rib structure. After the lapping tool is removed from the facesheet, the facesheet springs back to its strain-free condition in places in which it was not supported during the grinding operation by the rib structure and, consequently, the surface of the facesheet takes on a topography which is characterized by high spots which result from the facesheet "springing back" after removal of the pressure applied by the grinding tool. This pattern is referred to as "print-through". While the print-through effect may be reduced by designing the mirror with a facesheet as thick as possible, this solution adds undesirable weight to the mirror structure. An alternate solution for reducing print-through is to substantially reduce the pressure used for grinding and polishing the reflecting surface. Unfortunately, this approach results in substantial additional time being required to finish the reflecting surface to the required surface geometry, and results in substantial additional cost being incurred in manufacturing mirrors having large reflecting surface areas. Consequently, neither of the foregoing solutions to print-through is entirely acceptable.

Another defect encountered in the prior art approach to fabricating mirrors with large surfaces areas is the difficulty of maintaining precise control of the surface geometry of segments of a mirror around the edges of each segment. These errors are frequently referred to as "residual edge zone errors" and are caused by the inability to efficiently control the distribution of material being removed from the facesheet in the area of the edge of the facesheets. This error results from the excessive tool pressure at the edge of the segment and from the differential tool wear while the tool overhangs the segment's edge because of the need to effectively finish the optical surface along the edge. Obviously, when a segmented mirror is to be assembled from a number of segments, the problem of edge zone control becomes substantial due to the appreciable surface area of the mirror which the edges of each segment comprise.

SUMMARY OF THE INVENTION

A principle object of the invention is to provide a tool for grinding and polishing the reflecting surface of a mirror which will permit an efficient removal of material across all portions of the reflecting surface.

Another object of the invention is to provide a tool for grinding and polishing the reflecting surface of a mirror having a thin facesheet which will prevent the production of surface anomalies in the reflecting surface due to the non-uniformity of the support structure supporting the reflecting surface.

Another object of the invention is to provide a tool for the fabrication of the reflecting surfaces of a segmented mirror which will insure proper geometry of the edges of each of the segments to permit the segments to be joined together without surface discontinuities occurring between adjoining surfaces.

Still a further object of this invention is to provide a tool for grinding and polishing the reflecting surface of a mirror which will permit high rates of removal of material from the surface while accurately controlling the shape of the surface.

Another object of this invention is to provide a tool for grinding and polishing the reflecting surface of a mirror which will permit a complex shape to be ground into a mirror's reflecting surface with minimal use of skilled manpower.

The above and other objects and advantages of the invention are achieved by utilizing a lapping tool which is held in contact against a surface to be finished by the use of a suction force developed between the tool and the optical surface being finished. The tool includes a body having a plurality of buttons on the lower face which contact the optical surface to be lapped. Each button has a hollow cavity at the lower extremity thereof to permit a suction to be developed between the tool and the optical surface. The suction force applied between each button and the workpiece may be varied to control the work rate of the tool, i.e., the rate of removal of material and the rate at which polishing occurs across the mirror's surface. In addition, a control system is disclosed to control the application of suction to different points across the surface of the tool to permit the force exerted by the tool against the workpiece to be varied depending upon the location of the tool with respect to the edge of the surface being finished. As the tool is moved toward an edge of a mirror or a segment of a mirror, the suction applied to those portions of the tool about to overlap the edge is removed, and additional suction is applied to that portion of the tool still on the mirror's surface, to insure that desired removal rates of material at the edges are achieved. In addition, the invention provides for the capability for controlling the distribution of the material removal rate by the tool across the contact area of the tool by providing a programmable means for varying the amount of suction achieved within the tool's face.

BRIEF DESCRIPTION OF THE DRAWING

The foregoing objects and other advantages of the invention will be readily understood by reference to the detailed description of a preferred embodiment when read in conjunction with the accompanying drawings in which:

FIG. 1 is a pictorial view of a segmented mirror whose segments may be manufactured using the invention;

FIG. 2 is a sectional view of a grinding and polishing tool which is constructed in accordance with the teachings of the invention;

FIG. 3 is a top view of the grinding/polishing tool of FIG. 2;

FIG. 4 is a schematic view of a vacuum system and controller which may be used to control the vacuum applied between the optical surface and the grinding-/polishing tool;

FIG. 5 is a schematic illustration of the control system used to control the amount of vacuum applied to the tool;

FIG. 6 is a logic table which shows the amount of vacuum applied between the tool and the workpiece for various portions of an optical surface being worked on.

DETAILED DESCRIPTION OF A PREFERRED EMBODIMENT

Figure 7:
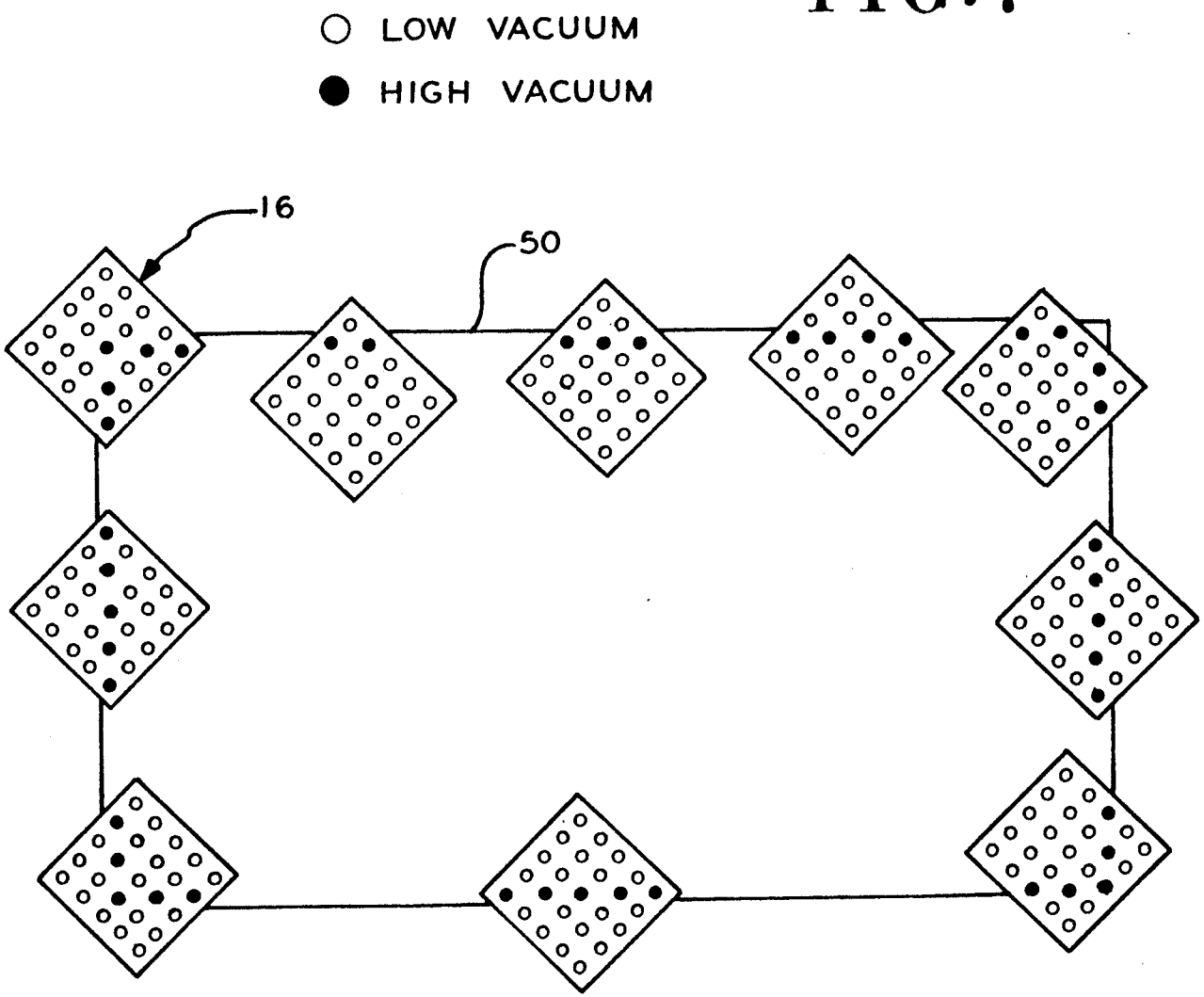
FIG. 7 shows a typical arrangement for the application of vacuum to the tool when used to grind or polish a rectangular workpiece.

Referring to the drawing, FIG. 1 shows a segmented mirror 10 composed of six outer segments 12 and an inner segment 14. The segments are individually machined to reduce their weight and are then assembled on a common support (not shown) to permit a large optical surface to be manufactured from smaller, more easily handled individual elements. It will be appreciated by those skilled in the art that difficulty is encountered during optical fabrication of the edges of each segment 12 or 14 because of the necessity to control the application of desired pressure applied by grinding and polishing tools to the optical surface at the edges of each of the segments, the tool overhangs the edge of each segment during some portion of the fabrication process. This error becomes appreciable when one is attempting to achieve a uniform surface across the assembled segments of the mirror, which is required for mirrors suitable for use in astronomical or surveillance applications.

FIG. 2 shows a tool 16 which may be used for lapping the surface of an optical element, i.e., which may be separately configured for grinding or for polishing applications and which embodies the teachings of the present invention. The tool 16 includes a body portion 18 having a centered aperture 20 into which a spindle 22 may be fit. While a centered aperture 20 is shown in the body 18 for connecting the tool 16 to a milling machine through the spindle 22, it will be obvious to those skilled in the art that any other suitable form of connection between the tool 16 and a milling machine may be used, i.e., a ball and socket arrangement fastened to the top surface of body 18 could be used equally as well to provide the connection between the tool 16 and the milling machine. While FIG. 3 shows the body 18 as being in the shape of a parallelogram, it is to be understood that the particular shape of the body is not essential to carrying out the teachings of the invention. Spindle 22 may be attached to a computer controlled machine to permit movement of the tool in five or six axes across the surface of the optical element to be worked on. The body 18 includes a series of apertures 24. A foam pad 26 is fastened to the bottom of the body 18 of the tool, for example by the use of an adhesive, and a relatively rigid surface 28 made, for example, from plexiglass, is fastened to the foam pad 26. The density of foam pad 26 is selected to permit some movement between body 18 of the tool and surface 28 so that the tool can conform to the shape of the surface being lapped. During times when optical surfaces having a flat surface or spherical geometry are being lapped, it is possible to eliminate foam pad 26 by having the surface 28 fastened directly to the bottom of the body 18 or by directly fastening the buttons 30 to the bottom surface of body 18. A plurality of lapping buttons 30 are fastened to the bottom of the surface 28. Each lapping button 30 is made from material chosen to achieve the desired removal rate of material from the optical surface being worked on by using an abrasive or polishing compound selected with regard to the material from which the optical surface is manufactured. For example, the buttons 30 may be made from a ceramic material or from a tar pitch which is well known to those skilled in the art of grinding and polishing optical surfaces. The particular material used for manufacturing the buttons 30 may be selected depending upon the extent of material to be ground from the optical surface being worked on and the desired removal rate. The number of buttons 30 used on each tool 16 and their surface area is selected based on the geometry to be ground into the optical surface, the desired removal rate of material, and the physical characteristics of the material from which the optical element is manufactured.

A means for applying a vacuum between the lapping tool 16 and an optical surface being worked on includes the depressions or apertures 32 formed at the bottom of each of the lapping buttons 30. A hollow tube 34 resides in each of the apertures 24 in the body of the tool 16 and is connected to each depression and to a vacuum source through a flexible vacuum line (not shown) to permit a suction to be produced between each button 30 and the optical surface through each aperture 32 while permitting the tool 16 to be moved across the surface of the optical element. Each button 30 can be separately connected to an individually-controlled vacuum line, or several buttons 30 can be connected together to a vacuum source via a common vacuum line.

FIG. 4 best illustrates an example of an arrangement for applying a vacuum to each button 30 through a vacuum control means shown generally at 36. Vacuum control means 36 includes solenoid valves 38 which are connected to a high vacuum source 40 and to a low vacuum source 42. A set of vacuum sensors 44 are connected between the vacuum control means 36 and each of the buttons 30 in the tool 16. A programmable logic controller 46 is connected to each solenoid valve 38 and to the vacuum sensors 44. Programmable logic controller 46 may be any type of controller, for example a general purpose computer, which will apply signals to solenoids 38 and receives signals from vacuum sensors 44 to control the application of high or low vacuum, or no vacuum, to each of the grinding buttons 30, in response to a preprogrammed set of conditions entered into controller 46. The vacuum control means 36 is shown as having a series of vacuum gauges 48 for monitoring the amount of vacuum applied to each of the buttons 30. The controller 46 is provided with the input from vacuum sensors 44 to generate command to valves 38 for proper application of low, high or no vacuum to each individual button 30 in response to the position of the tool 16 with respect to an edge of the optical element being lapped.

FIG. 5 is a schematic representation of how the low vacuum and high vacuum lines may be attached to tool 16 through the lines 34 while permitting the vacuum in lines 34 to be monitored by the vacuum gauges 48. FIG. 5 also shows that the solenoids 38 may be used to alternately select the low vacuum or high vacuum to be applied to each of the buttons 30, while the vacuum sensors 44 are used to monitor loss of vacuum due to the overhanging of the segment's edge by one or more of the buttons 30. While the preferred embodiment described herein is disclosed as using only two levels of vacuum, i.e., a high or low vacuum, it is to be understood that many levels of vacuum could be used, depending upon the sophistication of the program logic control available and the complexity of the surface to be machined.

Vacuum sensors 44 serve to signal when one or more of the buttons 30 have reached the edge of a workpiece. When one or more of the buttons overhang the edge of the workpiece, the suction between the workpiece and the button 30 is lost, an event which will register on the appropriate vacuum sensor 44 monitoring the respective button 30. By programming programmable logic controller 46 to recognize the pattern of buttons 30 in which suction has been lost, it is possible to determine, based on the presence or absence of a suction across the face of the tool 16, the location of the tool 16 with respect to the edge of the workpiece. This information can be used to direct the solenoid valves 38 to close or open according to predetermined pattern to achieve low or high vacuum as shown on FIG. 7.

FIGS. 6 and 7 show how a twenty-five button tool 16 may be used to grind and/or to polish the surface of a rectangular blank depicted in FIG. 7 at 50, by selectively controlling the vacuum applied to various parts of the tool 16. During work on the interior zone of an optical element, all buttons 30 are supplied with a low vacuum. As soon as any button 30 crosses an edge of the blank, it will lose vacuum, which event will be a signal that the tool is entering the edge zone of the element. This event will be detected by one or more of the vacuum sensors 44 and conveyed to the program logic controller 46. Typically, the tool 16 will continue to move over the edge of the optical element 50 until its center has reached the edge. At this point the machine controlling the motion of travel of tool 16 will reverse motion of the tool 16 toward the interior of the optical element. Depending upon the specific position of the tool 16 in the edge zone, a configuration of buttons 30 will lose vacuum, which event will be detected by the program logic controller 46. After identifying the configuration, the program logic controller 46 will activate solenoids for each individual button 30 according to a predetermined pattern of vacuum to be applied to the tool 16.

While the invention has been described utilizing a tool in which a high vacuum or low vacuum, or no vacuum are selectively applied to each of the buttons 30, it will be appreciated by those skilled in the art that a vacuum of variable magnitude could also be selectively applied to the buttons 30 to selectively tailor the force applied by the tool to the workpiece during the grinding or polishing operation with respect to any particular area of the underside surface of the tool. In addition, the rate at which material is removed and/or the rate of polishing can be varied by appropriate selection of the material used to form the buttoms 30 and the amount of vacuum applied between the tool and the workpiece. The specific embodiment described herein is offered by way of example only and the disclosed invention is intended to be limited only by the permissible scope of interpretation of the appended claims.

I claim:

1. A tool for finishing the reflecting surface of an optical element having one or more edges, said tool being comprised of:

a. a body portion, said body portion including means for connecting said tool to external drive means for moving said tool across the reflecting surface of an optical element;

b. a plurality of lapping buttons rigidly fastened to the body portion of said tool for removing material from the reflecting surface of the optical element by the movement of said tool by said external drive means across the reflecting surface of the optical element, each of said lapping buttons having an aperture passing through said lapping button;

c. means connected to the apertures in one or more of said lapping buttons for selectively producing a vacuum between said lapping buttons and the reflecting surface of said optical element to hold said tool against the reflecting surface of the optical element as the tool is moved by the external drive means across the reflecting surface of said optical element and partially over one or more edges of the optical element, and d. a controller connected to said means connected to the apertures in one or more of said lapping buttons for selectively producing a vacuum between said lapping buttons and the reflecting surface of said optical element for controlling the application of a vacuum to individual ones of said lapping buttons in response to the position of said tool on the reflecting surface of said optical element.

2. The tool of claim 1 wherein each lapping button is connected to said means for selectively producing a vacuum.

3. The tool of claim 2 further including means between the body portion of said tool and said lapping buttons for conforming the tool to the shape of the reflecting surface.

4. The tool of claim 2 wherein said means for producing a vacuum between the lapping buttons and the optical element may be controlled to selectively produce a high vacuum or a low vacuum or no vacuum between selected one of said lapping buttons and the reflecting surface of the optical element.

5. The tool of claim 1 wherein the position of said tool in relation to an edge of said optical element is detected by the loss of a vacuum between one or more of said lapping buttons and the reflecting surface of said optical element.

6. The tool of claim 5 wherein groups of two or more lapping buttons are connected by a common vacuum line to the means for selectively producing a vacuum between said lapping buttons and the reflecting surface of said optical element.

7. The tool of claim 5 further including means for determining when a portion of said tool is overhanging an edge of an optical element.

8. The tool of claim 7 wherein the direction of travel of said tool across the reflecting surface of said optical element is controlled by the means for determining when a portion of said tool is overhanging an edge of said optical element.

9. A tool for lapping the reflective surfaces of optical elements, said tool being comprised of:

a. a tool body, said tool body including a lower surface and means for connecting said tool body to an external drive means for moving said tool across the reflective surface of an optical element;

b. a complaint layer fastened to the lower surface of said tool body;

c. a plurality of lapping buttons, at least some of said lapping buttons each having an aperture passing therethrough;

d. means for fastening said lapping buttons to said compliant layer;

e. means connected to the apertures in at least some of said lapping buttons for producing a suction between said lapping buttons having apertures and the surface of an optical element to hold said tool against optical surface when at least some of the lapping buttons of said tool are on the surface of said optical element;, and f. a controller connected to said means connected to the apertures in at least some of said lapping buttons for producing a suction, said controller selectively controlling the application of suction in individual ones of said lapping buttons in response to the position of said tool on the reflecting surface of said optical element.

10. A tool for lapping the reflecting surface of an optical component having one or more edges in response to the movement of said tool across the reflecting surface by an external drive means, said tool being comprised of a body portion; a plurality of means attached to said body portion for lapping the reflecting surface of the optical element by the movement of the tool across the reflecting surface of the optical element;, at least some of said lapping means having apertures there through and a vacuum source connected to the apertures in one or more of said means for lapping the reflecting surface of the optical element for maintaining a suction force between the body portion of said tool and the reflecting surface of said optical component independent of the location of said tool with respect to an edge of the reflecting surface of the optical element; and a controller for adjusting the suction between individual ones of said lapping means and the reflecting surface of the optical component in response to the position of said tool with respect to an edge of the reflecting surface of the optical component.

11. The tool set forth in claim 10 further including means for monitoring the suction between at least some of said means for lapping and the reflecting surface of the optical component.

12. The tool set forth in claim 10 further including compliant means between said body portion and said means for lapping for adjusting the fit of said means for lapping to the shape of the reflecting surface of the optical component.

* * * * *